US011242667B2

(12) United States Patent
Lee et al.

(10) Patent No.: US 11,242,667 B2
(45) Date of Patent: Feb. 8, 2022

(54) WORK VEHICLE INCLUDING LOADER WORK DEVICE

(71) Applicant: DAEDONG CORPORATION, Daegu (KR)

(72) Inventors: Hun Jung Lee, Gyeongsangnam-do (KR); Yong Woo Kim, Gyeongsangnam-do (KR)

(73) Assignee: DAEDONG CORPORATION, Daegu (KR)

( * ) Notice: Subject to any disclaimer, the term of this patent is extended or adjusted under 35 U.S.C. 154(b) by 0 days.

(21) Appl. No.: 16/546,303

(22) Filed: Aug. 21, 2019

(65) Prior Publication Data

US 2020/0071905 A1 Mar. 5, 2020

(30) Foreign Application Priority Data

Aug. 29, 2018 (KR) ..... 10-2018-0101707

(51) Int. Cl.
*E02F 3/34* (2006.01)
*E02F 3/36* (2006.01)
*E02F 9/16* (2006.01)

(52) U.S. Cl.
CPC ..... *E02F 3/3414* (2013.01); *E02F 3/3695* (2013.01); *E02F 9/16* (2013.01)

(58) Field of Classification Search
CPC ..... E02F 3/3405; E02F 3/3408; E02F 3/3411; E02F 3/3414; E02F 3/38; E02F 3/422
USPC ..... 414/685, 700, 728, 742
See application file for complete search history.

(56) References Cited

U.S. PATENT DOCUMENTS 3,215,292 A * 11/1965 Halls ..... E02F 3/3405 414/707
3,586,195 A * 6/1971 Beltrami ..... E02F 3/308 414/707
3,995,761 A * 12/1976 Hurlburt ..... E02F 3/3405 414/713
4,355,946 A * 10/1982 Wykhuis ..... E02F 3/3405 414/707
5,511,932 A * 4/1996 Todd ..... E02F 3/3405 414/685
5,609,464 A * 3/1997 Moffitt ..... E02F 3/3405 414/685
6,132,163 A * 10/2000 Andrews ..... E02F 3/3405 414/685
6,205,665 B1 3/2001 Anderson et al.
6,854,951 B2 * 2/2005 Mimuro ..... E02F 3/308 414/685

(Continued)

*Primary Examiner* — Saul Rodriguez
*Assistant Examiner* — Brendan P Tighe
(74) *Attorney, Agent, or Firm* — Revolution IP, PLLC

(57) ABSTRACT

Provided is a work vehicle including a cabin and a loader work device. The work vehicle includes: a vehicle main body; a main body rear; front and rear wheels; a bucket; a lifting arm connected to the bucket to lift the bucket; a boom support connected to the lifting arm; a rear link having one end coupled to a first boom support hinge part of the boom support and an opposite end coupled to a rear hinge part of the main body rear; a boom cylinder having one end coupled to a second boom support hinge part of the boom support to rotate the boom support; and a rotation link having one end coupled to a third boom support hinge part of the boom support and an opposite end coupled to a front hinge part of the vehicle main body.

4 Claims, 9 Drawing Sheets

(56) References Cited

U.S. PATENT DOCUMENTS

| | | | | |
|---|---|---|---|---|
| 10,443,209 | B2 * | 10/2019 | Kumbhar | E02F 3/422 |
| 2004/0228715 | A1 * | 11/2004 | Roan | E02F 3/34<br>414/680 |
| 2005/0133294 | A1 * | 6/2005 | Jung | B66F 9/0655<br>180/414 |
| 2014/0212254 | A1 * | 7/2014 | Martin | E02F 3/3414<br>414/680 |

* cited by examiner

WORK VEHICLE INCLUDING LOADER WORK DEVICE

BACKGROUND OF THE INVENTION

1. Field of the Invention

The present invention relates to a loader work device of a work vehicle, and more particularly, to a loader work device capable of moving a bucket connected to a loader vertically upward through a simple structure of a shaft and a cylinder. The loader work device may be used in industrial vehicles, construction equipment, and agricultural loader work machines, and may also be used in a skid steer loader (SSL) or a compact track loader (CTL).

2. Description of the Related Art

A loader work machine is provided with a pair of left and right arms on both sides of a base frame of a work vehicle, and a work tool (bucket) on ends of the left and right arms.

In addition, the loader work machine is provided with a hydraulic actuator for operating the work tool, and the ends of the left and right arms may vertically move up/down on a front side of the base frame through a pair of first lift links provided on rear left and right sides of the base frame and a pair of second left links provided on front left and right sides of the base frame. For example, the above loader work machine is described in the following case of Patent document 1.

(Patent document 1) U.S. Pat. No. 6,205,665 B1

FIG. 1 shows a state in which a bucket is being lifted in a conventional loader work machine.

Referring to FIG. 1, a loader work device is provided in a vehicle such as a tractor, a wheel loader, a skid loader, and a track loader, and the loader work device includes a bucket 4 for lifting a conveyance target load.

In detail, in the case of the conventional loader work device, a lifting arm 30 having one side connected to the bucket 4 and an opposite side connected to a rear side of a vehicle main body 1, a lifting arm hinge part 31 serving as a rotation center of the lifting arm 30, a boom cylinder 20 for transmitting a force such that the lifting arm 30 rotates or moves up/down, and a cylinder hinge part 21 serving as a rotation center of the boom cylinder 20 are connected.

In addition, in the case of the conventional loader work device, the lifting arm hinge part 31 and the cylinder hinge part 21 are provided on the rear side of the vehicle main body 1, and rotate corresponding to the upward and downward movement of the lifting arm 30 according to movement caused by extension or compression of the boom cylinder 20.

Further, a cabin in which a user rides is provided between a front wheel 2 and a rear wheel 3 of the vehicle, and the cylinder hinge part 21 of the boom cylinder 20 and the lifting arm hinge part 31, which are components for rotating the lifting arm 30, are located on a rear side of the cabin or located over the rear wheel 3.

Due to the above structural problem, as shown in FIG. 1, when the bucket 4 is lifted up vertically (or when the lifted bucket 4 is moved down), a movement path of the bucket 4 is as follows that the bucket 4 moves forward by a distance A or moves rearward by a distance B according to the rotation of the lifting arm 30 upon the lifting of the bucket 4.

In other words, since the lifting arm 30 rotates about the lifting arm hinge part 31, the bucket 4 located at an end of the lifting arm 30 moves forward (A) or rearward (B) while being lifted. This causes the vehicle to move rearward by the predetermined distance A or to move forward by the predetermined distance B in order to move the bucket 4 vertically upward.

In the case of lifting the bucket of the loader work device vertically upward, a large amount of work loss may be caused when the vehicle moves forward or rearward according to the forward/rearward movement of the bucket 4.

SUMMARY OF THE INVENTION

The present invention is directed to provide a loader work device capable of minimizing fluctuation/movement of a bucket in a forward or rearward direction when the bucket is moved up/down.

In addition, the present invention is directed to propose a loader work device which has a simple structure of a link and a hinge part to vertically lift up and down the bucket so that an increase in manufacturing costs may be suppressed, and it may be advantageous for maintenance and repair works.

According to the present invention, there is provided a work vehicle including a cabin and a loader work device, the work vehicle including: a vehicle main body for supporting the cabin; a main body rear disposed on a rear side of the vehicle main body; front and rear wheels for moving the work vehicle; a bucket for receiving a load; a lifting arm connected to the bucket to lift the bucket up and down; a boom support connected to the lifting arm; a rear link having one end coupled to a first boom support hinge part formed in the boom support and an opposite end coupled to a rear hinge part formed in the main body rear; a boom cylinder having one end coupled to a second boom support hinge part formed in the boom support to rotate the boom support such that the lifting arm rotates or moves up and down; and a rotation link having one end coupled to a third boom support hinge part formed in the boom support and an opposite end coupled to a front hinge part formed at a front end of the vehicle main body.

According to the loader work device of embodiments, when the bucket is vertically moved up and down, the forward/rearward fluctuation can be minimized, and the upward/downward movement can be performed more accurately.

In addition, the number of components such as arms, links, and hinges is reduced, and hinge parts are shared so that a cost for the maintenance and repair works as well as a manufacturing cost can be reduced.

DETAILED DESCRIPTION OF THE INVENTION

Figure 5:
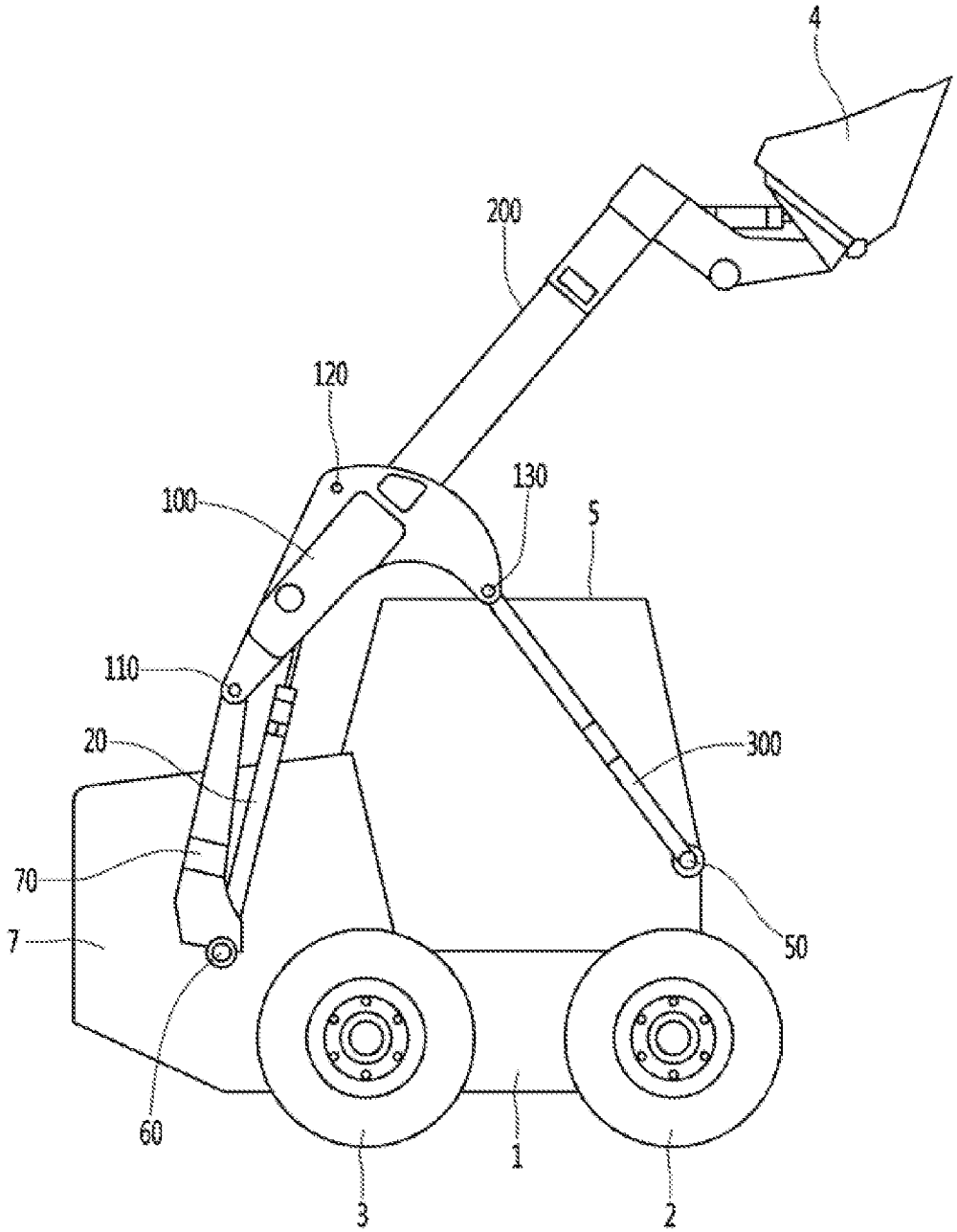
Figure 6:
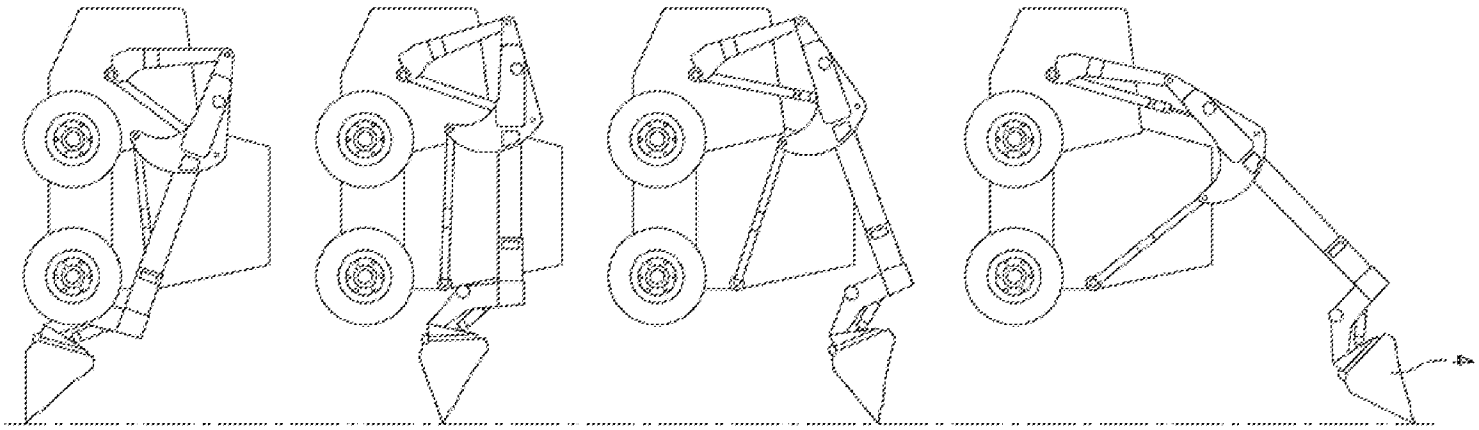
FIG. 6 is a view showing positions of the buckets during an operation of the loader work device according to the first embodiment.

FIGS. 2 to 5 are views showing a configuration and an operation process of a loader work device according to a first embodiment of the present invention, and FIG. 6 is a view showing positions of the buckets during an operation of the loader work device according to the first embodiment.

First, referring to FIGS. 2 to 5, in a loader work device of the embodiment, a vehicle such as a tractor and an industrial vehicle includes a cabin 5 in which a user rides, and a vehicle main body 1 configured to support the cabin 5 and connected with a front wheel 2 and a rear wheel 3.

In addition, a main body rear 7 for receiving components such as an engine is disposed on a rear side of the vehicle main body 1.

The loader work device of the embodiment includes a lifting arm 200 connected to the bucket 4 for loading or receiving a load, and a boom cylinder 20 for providing a force such that the lifting arm 200 moves up and down. In addition, the loader work device is provided with a boom support 100 for connecting the lifting arm 200 to the boom cylinder 20, and the boom support 100 has three hinge parts at mutually different positions.

In detail, the boom support 100 has a first boom support hinge part 110 to which a rear link 70 is rotatably connected, a second boom support hinge part 120 to which the boom cylinder 20 is connected, and a third boom support hinge part 130 connected to a rotation link 300 connected to a front side of the vehicle main body 1.

The first to third boom support hinge parts are disposed at mutually different positions in the boom support 100. In particular, the second boom support hinge part 120 is disposed at a position higher than the third boom support hinge part 130 so that the bucket may be vertically lifted up and down. The boom support 100 is curved in a 'reverse-L' shape, or is partially bent.

In the present embodiment, in order to suppress the movement of the bucket 4 in a forward/rearward direction when the lifting arm 200 rotates, the front hinge part 50 serving as the rotation center of the rotation link 300 is formed above the front wheel 2, and the rear hinge part 60 serving as the rotation center of the boom cylinder 20 is located on a rear side of the rear wheel 3 of the vehicle.

In particular, the rotation center of the rear link 70 connected to the first hinge part 110 of the boom support 100 is the same as the rotation center of the boom cylinder 20. In other words, since both ends of the rear link 70 and the boom cylinder 20 are connected to the rear hinge part 60, the number of hinge parts of the rear link 70 and the boom cylinder 20 may be reduced so that a cost for maintenance and repair works as well as a manufacturing cost can be reduced.

The rear hinge part 60 is formed in the main body rear 7 which is provided on the rear side of the vehicle main body 1, and such positioning takes into consideration the rotation of the lifting arm 200 and a movement position of the bucket 4.

The rear link 70 has one end connected to the rear hinge part 60, and an opposite end connected to the first boom support hinge part 110. When the boom support 100 rotates (e.g., in a counterclockwise direction) by an operation of the boom cylinder 20, the rear link 70 serves to move the boom support 100 rearward by a predetermined distance.

The rotation link 300 has one end connected to the front hinge part 50 which is formed vertically above the front wheel 2 of the vehicle, and an opposite end connected to the third boom support hinge part 130 of the boom support 100. When the boom support 100 rotates by the operation of the boom cylinder 20, the rotation link 300 serves to assist the rotation of the boom support 100 and support the lifting arm 200 coupled to the boom support 100.

Figure 1:
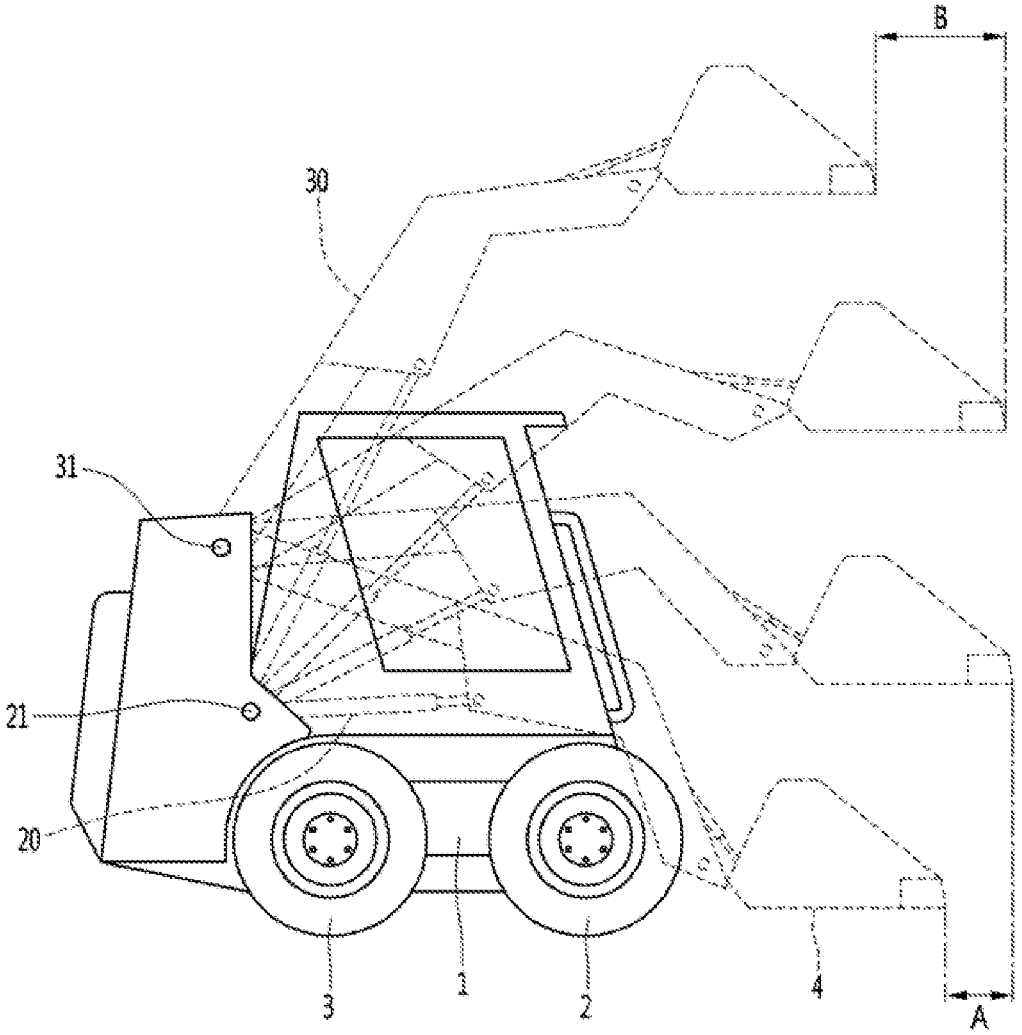
Fig. 1 Conventional Art
FIG. 1 shows a state in which a bucket is being lifted in a conventional loader work machine.
Figure 2:
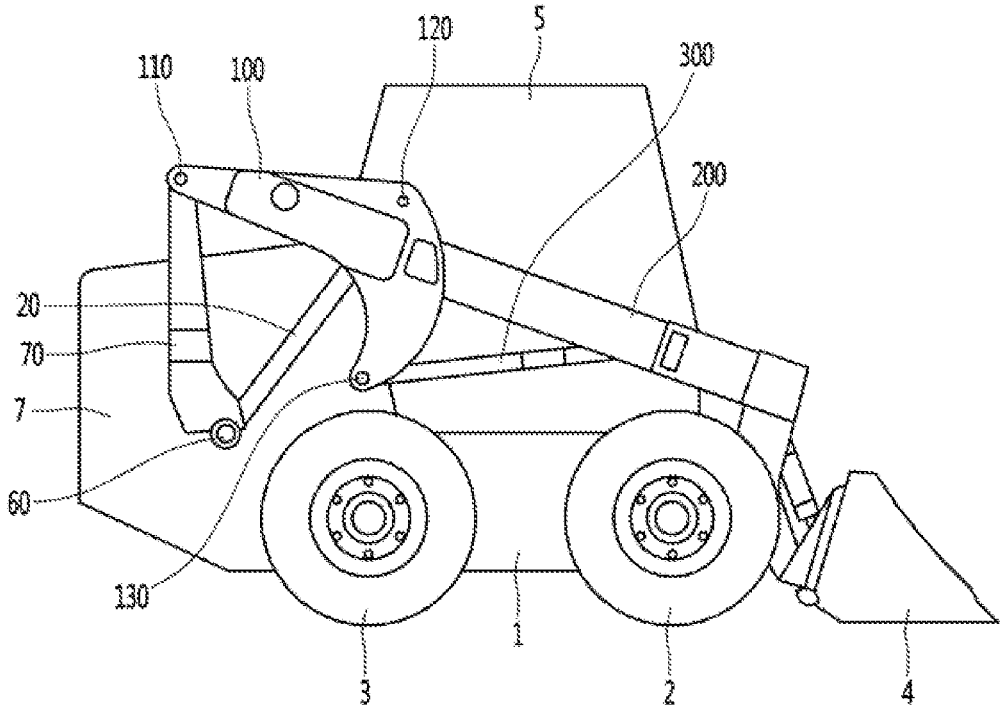
FIGS. 2 to 5 are views showing a configuration and an operation process of a loader work device according to a first embodiment of the present invention.
Figure 3:
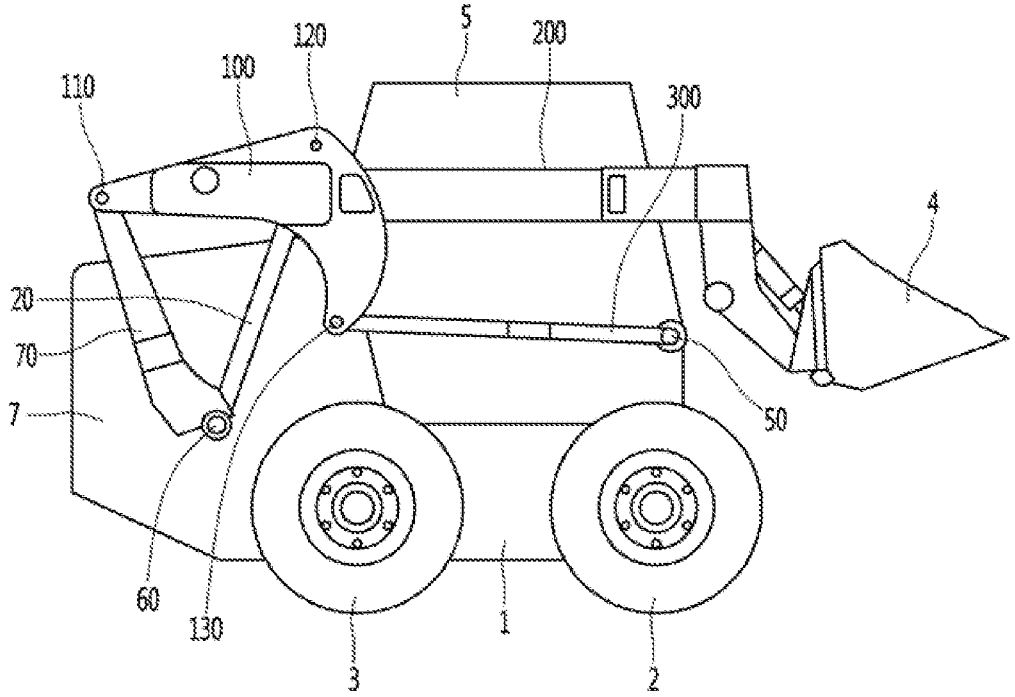
Figure 4:
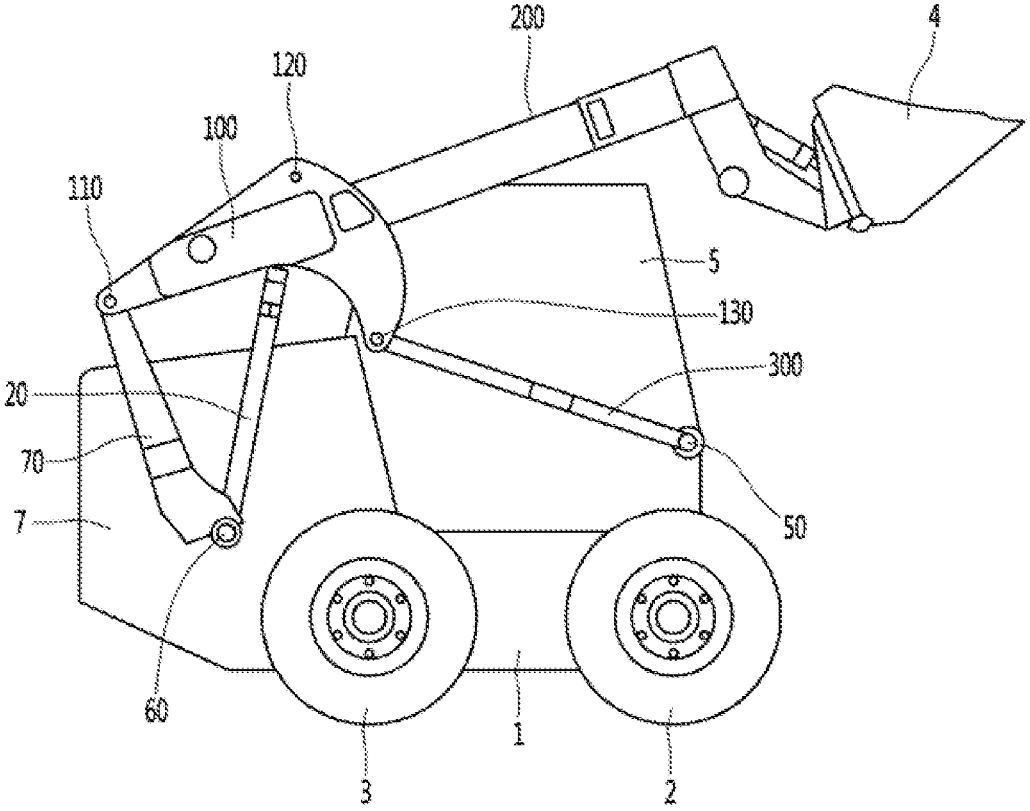

When the bucket 4 moves vertically upward in a state where the bucket 4 is moved down as shown in FIG. 2, the boom support 100 rotates in a counterclockwise direction while moving rearward by a predetermined length by the operation of the boom cylinder 20, and the rotation link 300 rotates in a clockwise direction at a predetermined angle.

In addition, the rear link 70 rotates in the counterclockwise direction, which is the same as a rotation direction of the boom support 100, at a predetermined angle.

As shown in FIG. 5, a length of the rotation link 300 has to be set such that the third boom support hinge part 130 forms an acute angle with the lifting arm 200 at a height corresponding to an uppermost position of the bucket 4 when the bucket 4 is lifted up.

As described above, since the boom support 100 has the first to third boom support hinge parts, and particularly, since the second boom support hinge part 120 is formed at the position higher than the third boom support hinge part 130, the boom support 100 may be partially curved. In addition, in operation states shown in FIGS. 2 to 5, the second boom support hinge part 120 is designed to be maintained at the position higher than the third boom support hinge part 130 even when the boom support 100 rotates.

With the above structures, the rotation of the rotation link 300 about the front hinge part 50 and the rotation of the boom cylinder 20 and the rear link 70 about the rear hinge part 60 may allow the bucket 4 to vertically move up/down while minimizing forward/rearward fluctuation of the bucket 4.

In the boom support 100, the first boom support hinge part 110 is formed rearward (left side in the drawing) of the vehicle, the third boom support hinge part 130 is formed forward (right side in the drawing) of the vehicle, the second boom support hinge part 120 is disposed forward of the third boom support hinge part 130 when the bucket 4 is located at a lowermost position, and the second boom support hinge part 120 is disposed between the first boom support hinge part 110 and the third boom support hinge part at a height at which the bucket 4 is lifted by a predetermined height or more.

In addition, the front hinge part 50, to which the opposite end of the rotation link 300 having the one end connected to the third boom support hinge part 130 is coupled, is formed under the cabin 5 located on the front side of the vehicle main body 1.

In addition, the opposite end of the rear link 70 coupled to the first boom support hinge part 110 and the opposite end of the boom cylinder 20 coupled to the second boom support hinge part 120 are coupled to the rear hinge part 60. When the bucket 4 is lifted by the operation of the boom cylinder 20, the rear link 70 initially rotates about the rear hinge part 60 in a direction which is the same as a rotation direction of the boom cylinder 20, and then the rear link 70 and the boom cylinder 20 rotate in opposite directions, so that an interval (angle) between the rear link 70 and the boom cylinder 20 becomes narrow. On the contrary, when the bucket 4 moves down after being lifted up, the rear link 70 and the boom cylinder 20 rotate in opposite directions so that the interval (angle) between the rear link 70 and the boom cylinder 20 is increased.

Due to the above configuration, as shown in FIG. 6, when the bucket 4 moves forward/rearward upon the lifting up/down of the bucket 4, the bucket 4 may move very slightly, and there is no inconvenience that the vehicle has to move in the forward/rearward direction.

Figure 7:
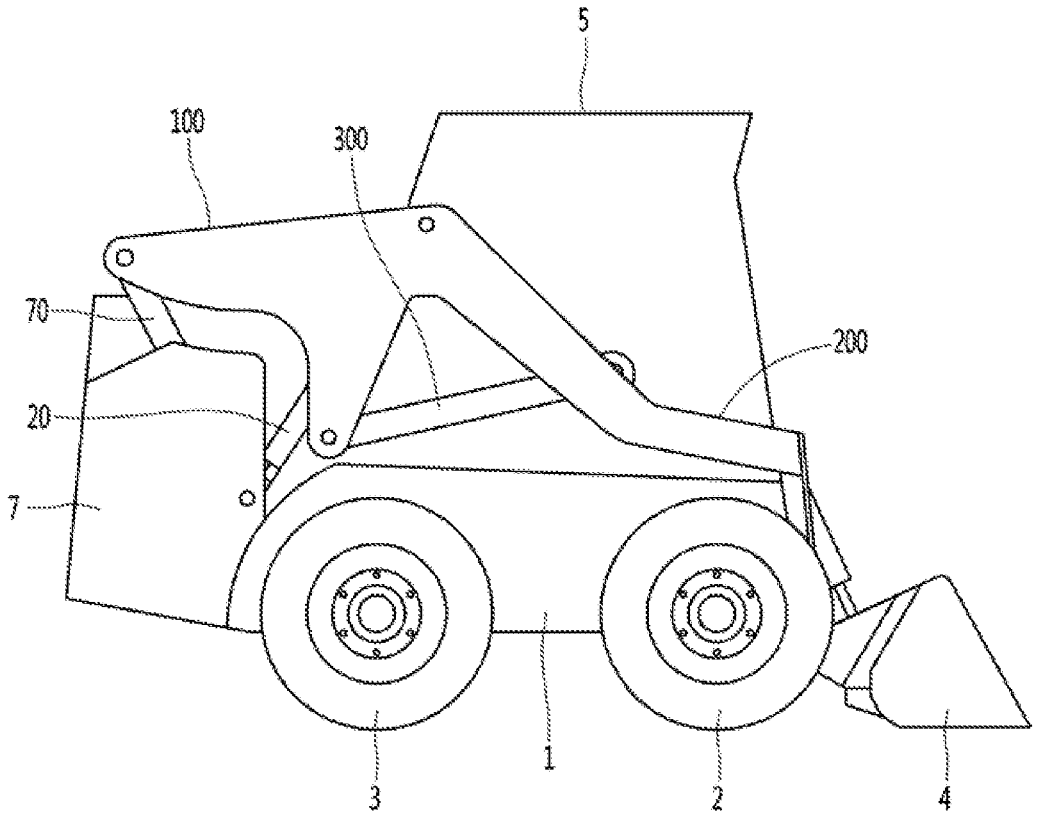
FIGS. 7 to 9 are views showing the configuration and the operation of the loader work device according to a second embodiment of the present invention.
Figure 8:
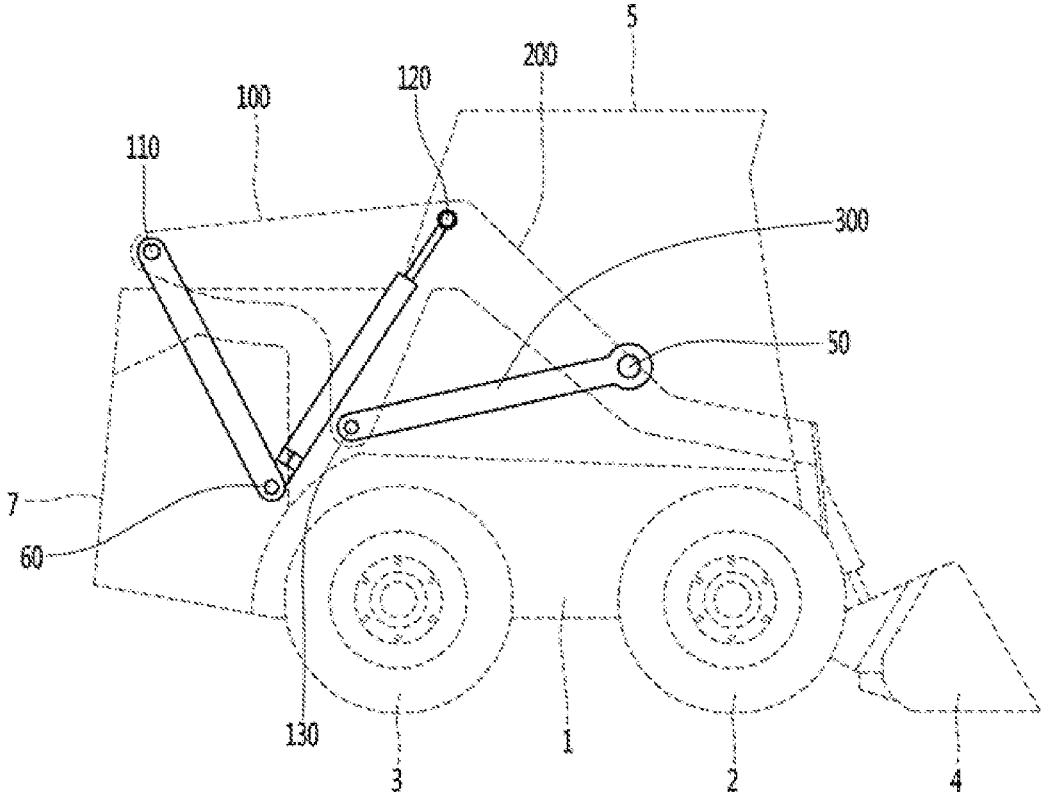
Figure 9:
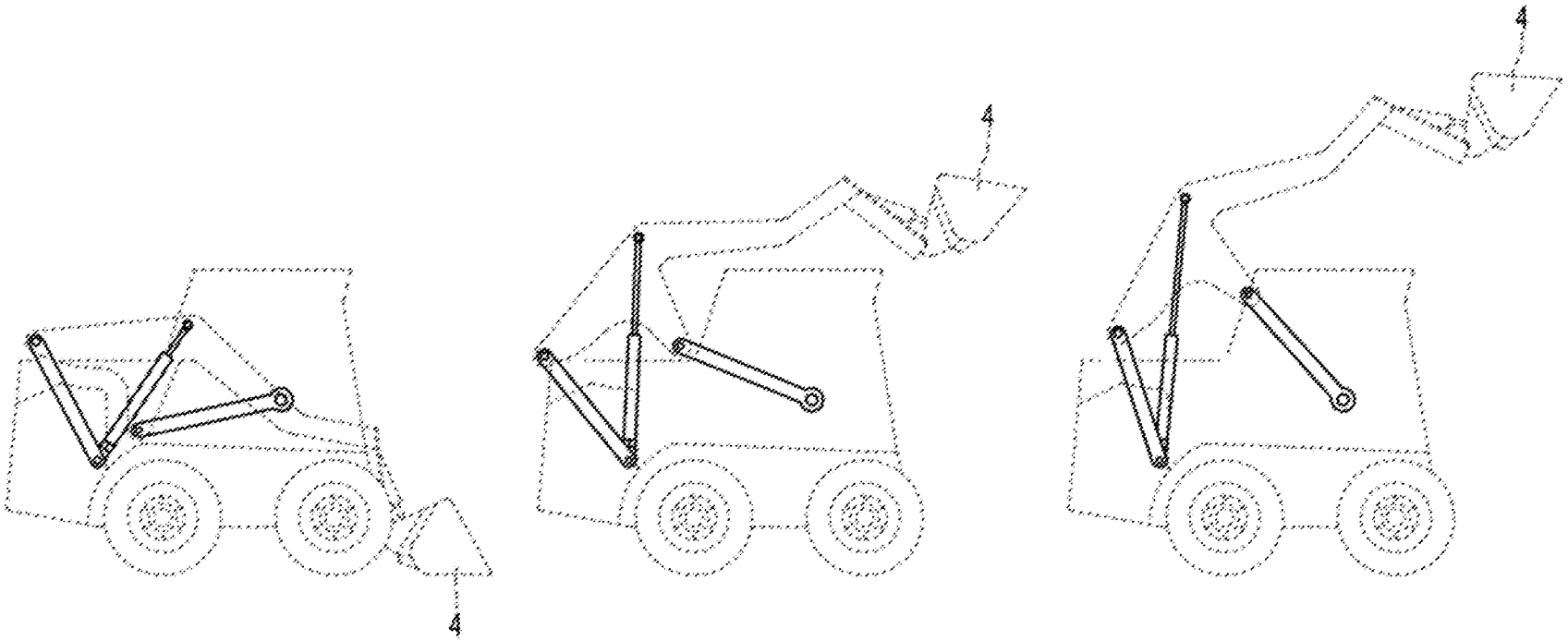

FIGS. 7 to 9 are views showing the configuration and the operation of the loader work device according to a second embodiment of the present invention.

A cover part for the boom support 100 and the main body rear 7 is shown by solid lines in FIG. 7, and components of the loader work device of the present invention are shown by solid lines in FIG. 8.

Operations of the second embodiment are performed similarly to the loader work device of the first embodiment described above. However, in the second embodiment, the lifting arm 200 to which the bucket 4 is coupled and the boom support 100 are formed in a single configuration, and particularly, the one end of the rotation link 300 is disposed toward a center of the vehicle main body 1.

In other words, in the case of the loader work device of the present invention, the one end of the rotation link 300 is coupled to the front hinge part 50 formed in the vehicle main body 1 or the cabin 5, and the opposite end of the lifting arm 200 is coupled to the third boom support hinge part 130. However, the front hinge part 50 may be located above the front wheel 2, or disposed above between the rear wheel 3 and the front wheel 2.

In addition, depending on a size of the vehicle and a length of the lifting arm 200, the rear hinge part 60 to which the boom cylinder 20 and the rear link 70 are coupled may also be located above the rear wheel 3 of the vehicle or on the rear side of the rear wheel 3.

The loader work device of the second embodiment may also vertically lift up/down the bucket 4 without the forward/rearward fluctuation of the bucket 4 as shown in FIG. 9, and a structure of the loader work device of the second embodiment is also configured such that the boom cylinder 20 and the rear link 70 are coupled to the rear hinge part 60 so that the structure can be simplified.

What is claimed is:

1. A work vehicle including a cabin and a loader work device, the work vehicle comprising:

a vehicle main body for supporting the cabin;

a main body rear disposed on a rear side of the vehicle main body;

front and rear wheels for moving the work vehicle;

a bucket for receiving a load;

a lifting arm connected to the bucket to lift the bucket up and down;

a boom support connected to the lifting arm;

a rear link having one end coupled to a first boom support hinge part formed in the boom support and an opposite end coupled to a rear hinge part formed in the main body rear;

a boom cylinder having one end coupled to a second boom support hinge part formed in the boom support to rotate the boom support such that the lifting arm rotates or moves up and down; and a rotation link having one end coupled to a third boom support hinge part formed in the boom support and an opposite end coupled to a front hinge part formed at a front end of the vehicle main body, wherein the one end of the boom cylinder is coupled to the second boom support hinge part, and an opposite end of the boom cylinder is directly coupled to the rear hinge part together with the rear link, wherein a rotation center of the rear link is same as a rotation center of the boom cylinder.

2. The work vehicle of claim 1, wherein the front hinge part is formed above the front wheel of the work vehicle, or formed vertically above between the front wheel and the rear wheel.

3. The work vehicle of claim 1, wherein the second boom support hinge part is formed at a position higher than the third boom support hinge part, and the second boom support hinge part is maintained at the position higher than the third boom support hinge part even when the boom support and the lifting arm rotate.

4. The work vehicle of claim 1, wherein the boom support is partially bent or curved.

* * * * *